US005228669A

United States Patent [19]

Kanaya

[11] Patent Number: 5,228,669

[45] Date of Patent: Jul. 20, 1993

[54] AUTOMATIC DOCUMENT FEEDER FOR AN IMAGE FORMING APPARATUS

[75] Inventor: Koichi Kanaya, Yokohama, Japan

[73] Assignee: Ricoh Company, Ltd., Tokyo, Japan

[21] Appl. No.: 763,455

[22] Filed: Sep. 20, 1991

[30] Foreign Application Priority Data

Sep. 21, 1990 [JP] Japan ..... 2-253125

[51] Int. Cl.[5] ..... B65H 83/00

[52] U.S. Cl. ..... 271/3; 270/53; 355/320; 271/65; 271/186

[58] Field of Search ..... 271/65, 186, 225, 301, 271/303, 3, 3.1, 4, 7; 270/53; 355/320

[56] References Cited

U.S. PATENT DOCUMENTS

| | | | |
|---|---|---|---|
| 3,416,863 | 12/1968 | Ralston | 271/303 X |
| 4,629,173 | 12/1986 | Hashimoto et al. | 271/65 |
| 4,657,238 | 4/1987 | Nishikawa | 271/65 X |
| 4,699,365 | 10/1987 | Smith et al. | 271/225 X |
| 4,736,937 | 4/1988 | Okuda et al. | 271/301 X |
| 4,945,390 | 7/1990 | Hasegawa et al. | 271/303 X |
| 5,031,893 | 7/1991 | Yoneda et al. | 271/186 X |
| 5,090,682 | 2/1992 | Takimoto | 271/225 |

FOREIGN PATENT DOCUMENTS

| | | | |
|---|---|---|---|
| 0114960 | 6/1986 | Japan | 271/301 |

*Primary Examiner*—H. Grant Skaggs
*Assistant Examiner*—Carol Lynn Druzbick
*Attorney, Agent, or Firm*—Oblon, Spivak, McClelland, Maier & Neustadt

[57] ABSTRACT

An automatic document feeder (ADF) for use with an image forming apparatus and freeing the operator from extra work associated with documents discharged after illumination. When the operator intentionally stacks the first page to the last page of documents in this order and sets them on an ADF table face down due to a copy discharge mode which requires the ADF to discharge the last page to the first page in this order face up, the ADF reverses the documents before discharging them. Hence, despite that the ADF discharges the documents from the last page to the first page, it successfully stacks the documents in order of page by turning them over.

3 Claims, 10 Drawing Sheets

AUTOMATIC DOCUMENT FEEDER FOR AN IMAGE FORMING APPARATUS

BACKGROUND OF THE INVENTION

The present invention relates to an automatic document feeder (ADF) for use with an image forming apparatus and, more particularly, to an ADF which frees the operator from extra work associated with documents discharged after illumination, e.g., rearranging them in order of page.

An ADF is extensively used with a copier or similar image forming apparatus for automatically feeding a plurality of documents to a scanning position one by one. As the ADF feeds such a document to the scanning position, the document is illuminated to reproduce an image thereof on a sheet. The sheet carrying the document image, i.e. a copy is driven out via a fixing station. It is desirable to free the operator from extra work associated with the copies driven out of the image forming apparatus, e.g., rearranging them in order of page or to allow such copies to be automatically stapled by a stapler. For this purpose, the operator is sometimes required to position a stack of documents in a particular manner on the table of the ADF, e.g., face up, face down, or the first page or the last page at the bottom. In some positions of the documents, therefore, the operator has to rearrange the pages or otherwise handle the documents having been discharged from the ADF thereby wasting time and labor.

SUMMARY OF THE INVENTION

It is, therefore, an object of the present invention to provide an ADF for an image forming apparatus which makes it needless for the operator to rearrange the pages or otherwise deal with documents having been discharged therefrom.

It is another object of the present invention to provide a generally improved ADF for an image forming apparatus.

In accordance with the present invention, an ADF for use with an image forming apparatus discharges sheets, each carrying a document image thereon, in either one of an ordinary position and a reversed position, and automatically sequentially feeds a plurality of documents from a table thereof to an illuminating position, the lowermost document being first while sequentially discharging them. The ADF comprises a first discharge path for discharging the documents undergone illumination in the same condition as the condition wherein they have been fed from the table, a second discharge path for discharging the documents undergone illumination after turning them over, and a path selector for selecting either one of the first and second discharge paths depending on the condition in which sheets carrying document images thereon are discharged and the condition in which the documents are stacked on the table in matching relation to such a condition of the sheets.

BRIEF DESCRIPION OF THE DRAWINGS

The above and other objects, features and advantages of the present invention will become more apparent from the following detailed description taken with the accompanying drawings in which.

DESCRIPTION OF THE PREFERRED EMBODIMENT

To better understand the present invention, problems with conventional ADFs will be described specifically.

Figure 8A:
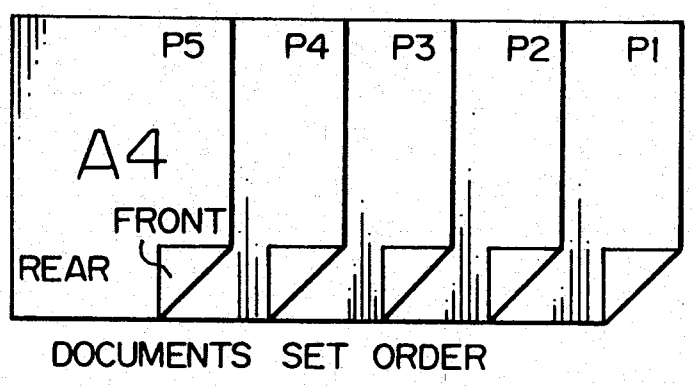
FIGS. 8A–8D show a relationship between the set condition and discharge condition of documents and the discharge condition of sheets or copies.
Figure 8B:
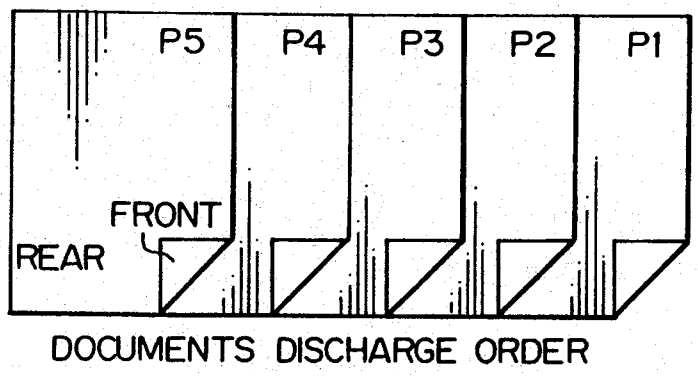

A conventional ADF is capable of discharging documents and copies thereof each in a particular mode selected by the operator. FIGS. 8A–8D of the accompanying drawings demonstrate a specific mode wherein documents are stacked on the table of an ADF face down, the first page being located at the bottom. The first page to the last page are sequentially fed out in this order (see FIG. 8A). These documents are driven out of the ADF face down after being scanned. Sheets carrying images thereon, i.e., copies of the documents are also discharged face down. In this kind of procedure, the copies are sequentially stacked face down from the first page to the last page. Therefore, all the copies can be stapled at the same position, as indicated by S in FIG. 8C (see FIG. 8D). As shown in FIG. 8B, the documents are sequentially discharged face down after illumination.

Figure 8C:
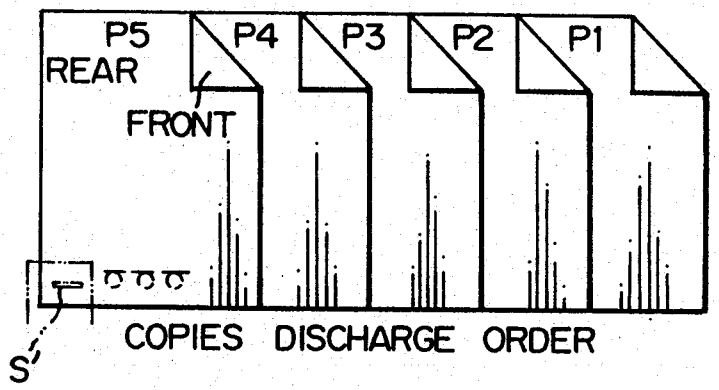

However, the above-described procedure has the following problem. Assuming that documents of format A4 are to be copied, they are stacked on the table face down with the first page positioned at the bottom and are oriented such that the longitudinal direction thereof is perpendicular to a scanning direction (indicated by an arrow in the figures). In this case, a stapler (represented by S in 8C) located at a predetermined position drives staples into all the stacks of copies at the same position, as shown in FIG. 8C. The documents are discharged one after another in same order as when set on the table and, therefore, do not have to be rearranged by hand.

Figure 8D:
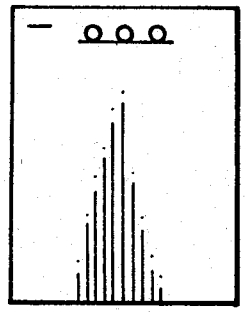
Figure 9B:
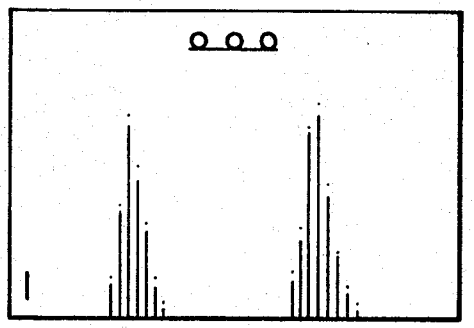
FIGS. 9A and 9B show a specific condition wherein copies of documents different in size from the documents shown in FIGS. 8A–8D are discharged.
Figure 9A:
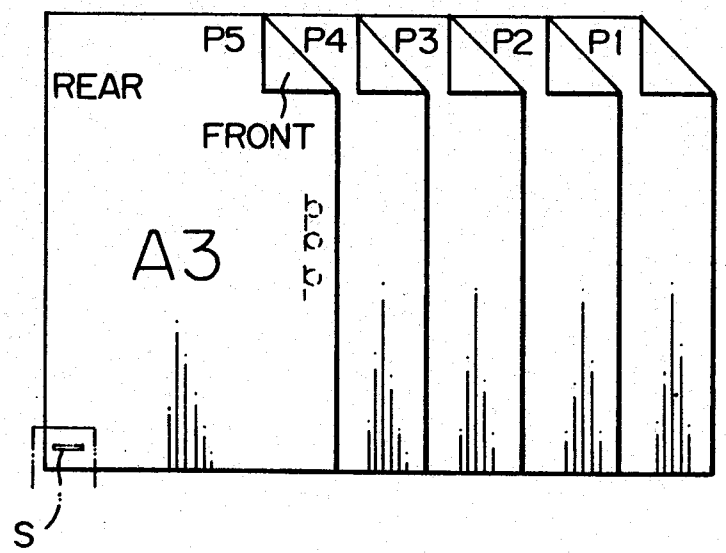

On the other hand, assume that the documents stacked on the table are of format A3 which is twice as long as the documents of format A4, as shown in FIGS. 9A and 9B. Then, copies of such documents are stapled at a position S shown in FIG. 9A which is entirely different from the position S shown in FIG. 8D and does not serve the expected function.

Figure 10B:
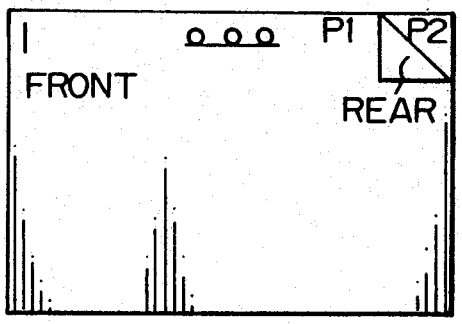
FIGS. 10A–10D show a relationship between another condition wherein copies of documents of the same size as the documents shown in FIGS. 9A and 9B are discharged and the set and discharge conditions of the documents.
Figure 10A:
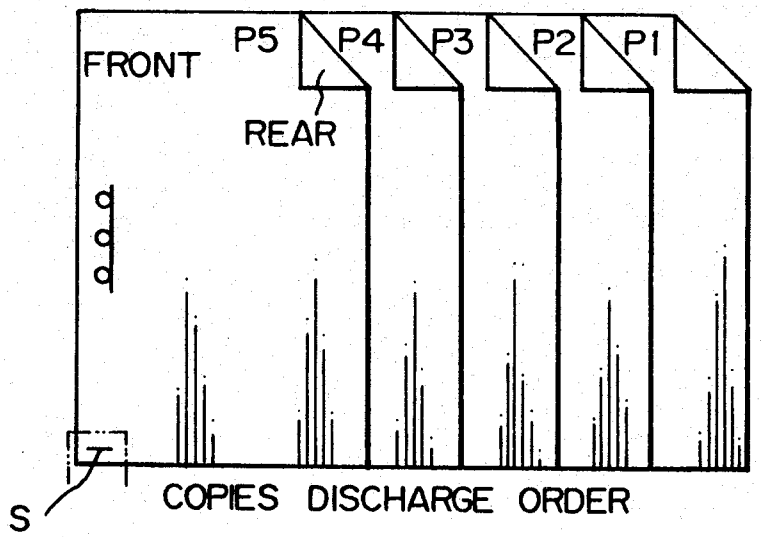
Figure 10D:
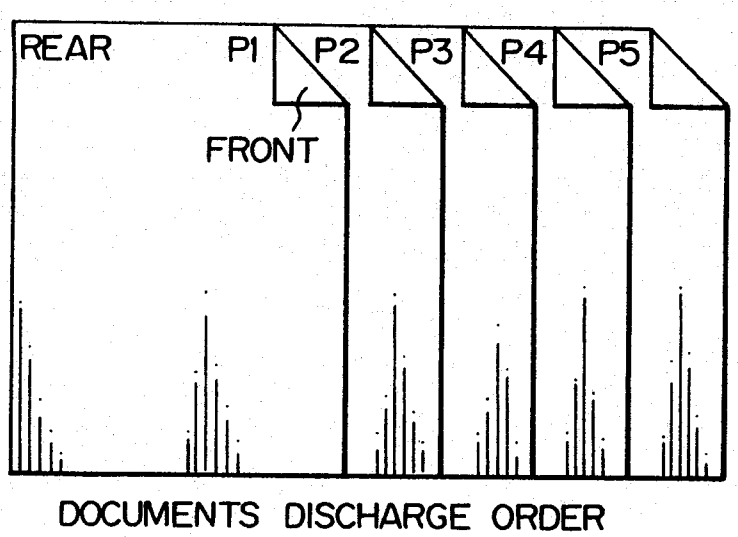
Figure 10C:
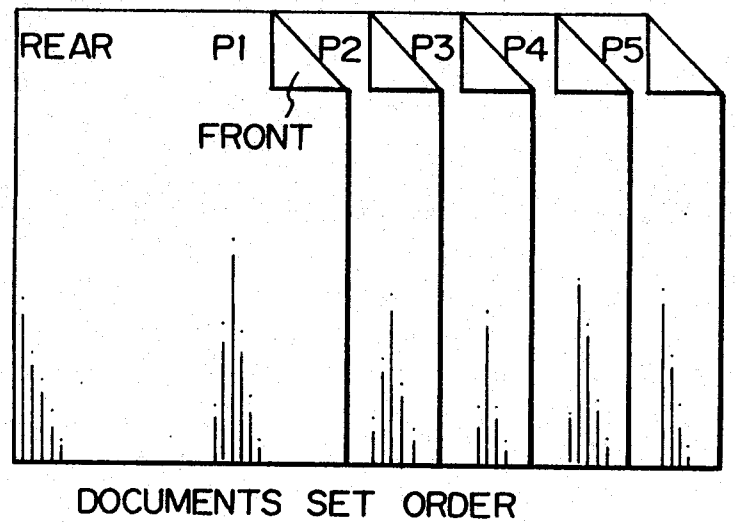

In light of the above, an arrangement may be made such that the copies are driven out face up in matching relation to the position of the stapler S, as shown in FIG. 10A. To discharge copies face up, however, documents have to be fed out in the order opposite to the order shown in FIGS. 8A-8D (see FIG. 10C) and, therefore, the operator has to change the order of documents before stacking them on the table. However, when the documents are fed in such an order, i.e., the last page first, they are discharged in the same order as the copies, requiring the operator to rearrange the pages of the discharged documents. This forces the operator to rearrange the documents in order of page twice in total, i.e., before setting documents on the table and after the discharge of the documents.

Figure 1:
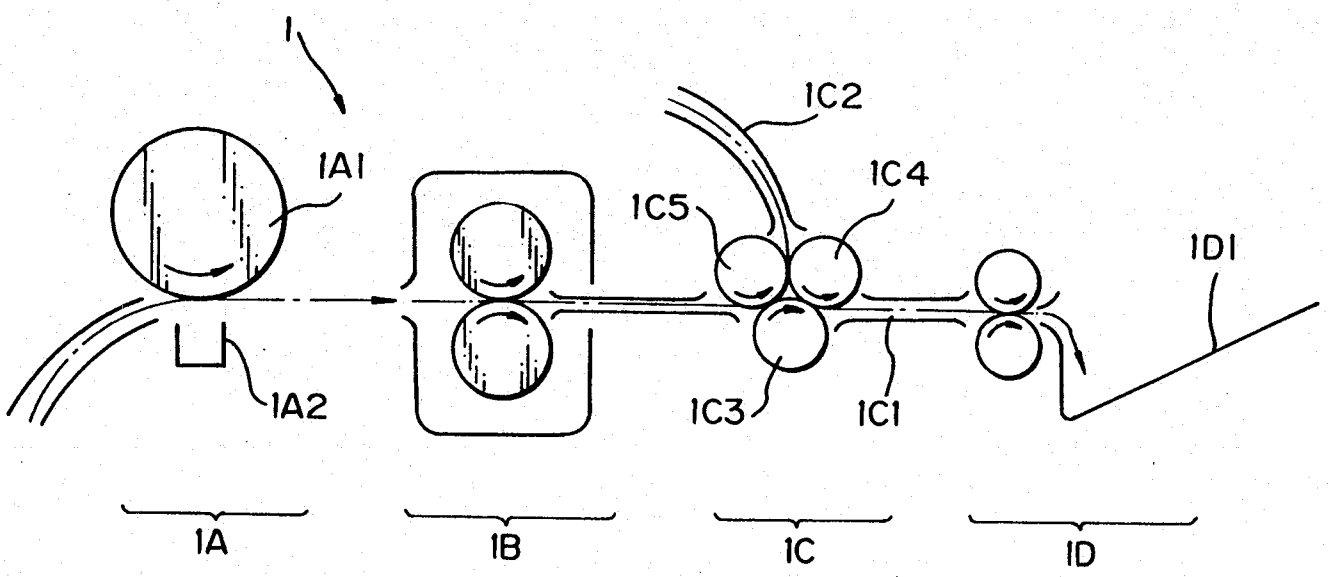
FIG. 1 is a view of an image forming apparatus implemented as a copier and to which an ADF embodying the present invention is applied.

Referring to FIGS. 1-7, an ADF embodying the present invention will be described in detail. FIG. 1 shows a copier to which the embodiment of the present invention is applied. As shown, the copier has a body 1 accommodating an image forming section 1A, a fixing section 1B, a reversing section 1C, and a discharging section 1D. The image forming section 1A includes a photoconductive element 1A1 implemented as, for example, a photoconductive drum. Arranged around the drum 1A1 are a charging station, illuminating station, developing station, and cleaning station each having a conventional configuration. At an image transferring station 1A2, an image formed on the drum 1A1 at the developing station is transferred to a sheet which is fed from a sheet feeding section, not shown. The sheet carrying the image thereon and moved away from the drum 1A1 is transported face up via the fixing station 1B to the reversing section 1C. At the fixing section 1B, the image is fixed on the sheet by, for example, heat.

The reversing section 1C has two different transport paths, i.e., a transport path 1C1 for driving the sheet, or copy, toward a tray 1D1 included in the discharging section 1D while maintaining it in the face-up position, and a transport path 1C2 for discharging the sheet after turning it over. Rollers 1C3 and 1C4 are located at the position where the paths 1C1 and 1C2 branch off each other. A selector in the form of a pawl, not shown, is positioned on the transport path extending from the fixing section 1B to the rollers 1C3 and 1C4 for selecting a particular transport direction. Specifically, as the operator sets up a desired copy discharge mode on the copier body 1, the selector selects either one of the transport paths 1C1 and 1C2. A sheet steered by the selector to the transport path 1C2 is turned over and then discharged to a tray, not shown, face down. On the other hand, a sheet driven into the transport path 1C1 is conveyed toward the discharging section 1D face up. A roller 1C5 is so located as to cooperate with the rollers 1C3 and 1C4.

Figure 2:
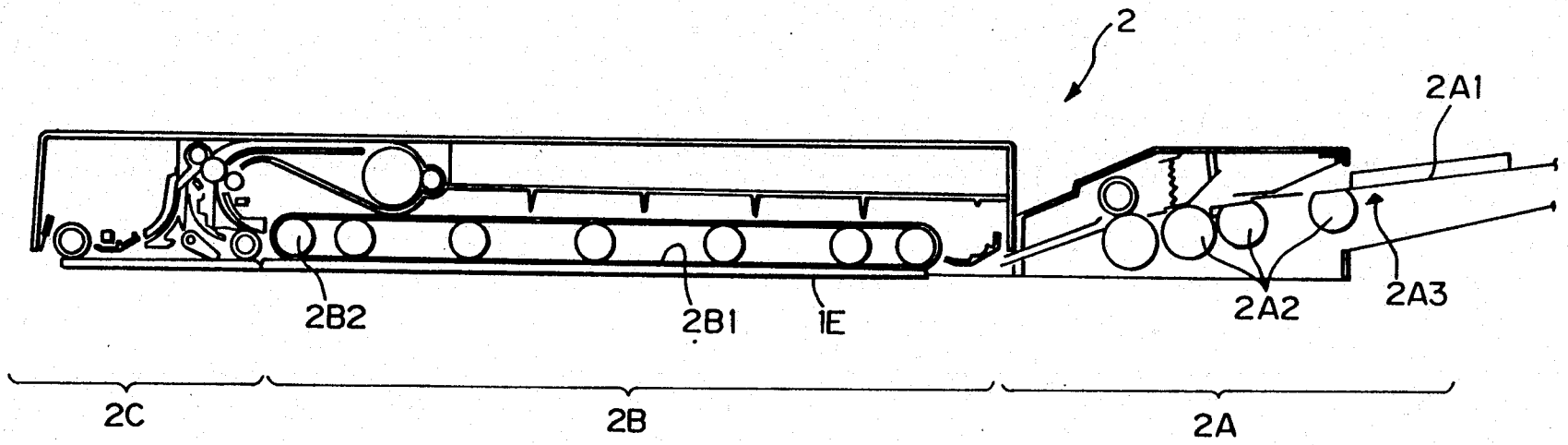
FIG. 2 is a section of the illustrative embodiment.

As shown in FIG. 2, the ADF, generally 2, is disposed above a platen 1E included in the copier body 1 and openable away from the platen 1E. The ADF 2 has a feeding section 2A, a transporting section 2B, and a discharging section 2C which are sequentially arranged in this order in a document feed direction (arrow). Major components of the feeding section 2A are a table 2A1 and feed rollers 2A2. The feeding section 2A sequentially feeds a stack of documents laid on the table 2A1, the lowermost document being first. The transporting section 2B has a belt 2B1 extending along the platen mounted on the top of the copier body 1. Pulleys over which the belt 2B1 is passed include a drive pulley 2B2 located at the downstream side with respect to the document feed direction. The belt 2B1 is moved and stopped by the drive pulley 2B2.

Figure 3:
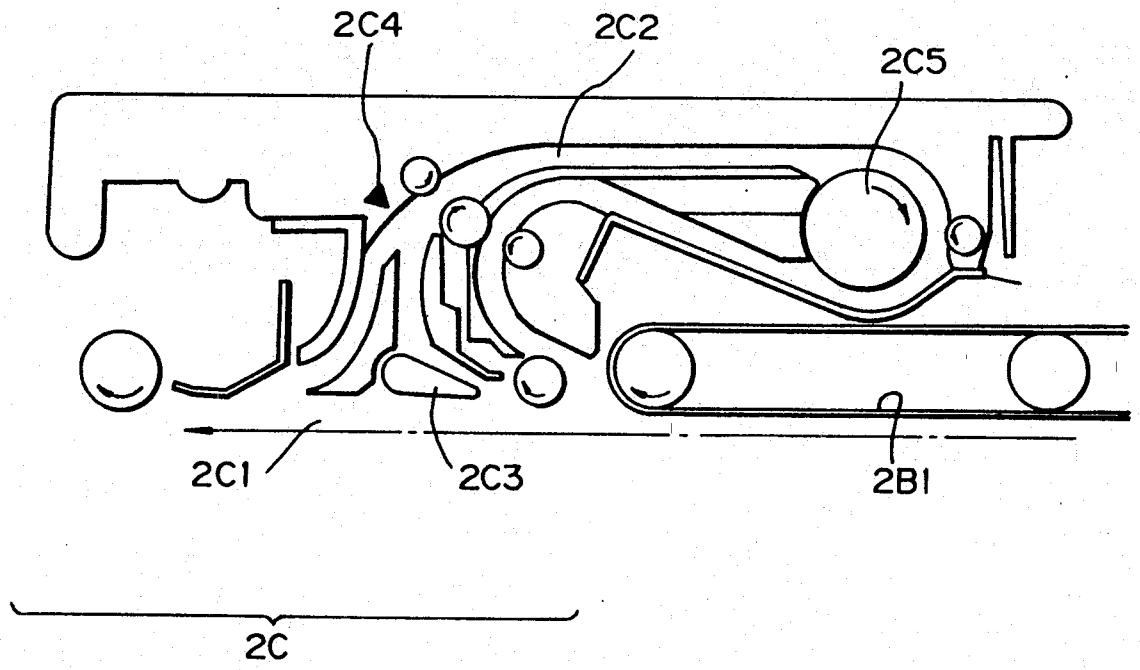
FIG. 3 is a fragmentary section of the embodiment.

As shown in FIG. 3, the discharging section 2C has an ordinary transport path 2C1 and a reversal transport path 2C2. The transport path 2C1 is positioned on the imaginary extension of the transport path defined by the belt 2B1, so that a document may reach a tray, not shown, without being turned over. The transport path 2C2 turns over an incoming document. A selector or pawl 2C3 is located at the position where the transport paths 2C1 and 2C2 branch off each other. The selector 2C3 steers a document from the belt 2B1 to either one of the transport paths 2C1 and 2C2 under the control of a control section which will be described. A sensor 2C4 and a reversible turn roller 2C5 are arranged on the transport path 2C2. The sensor 2C4 is responsive to the trailing edge of a document with respect to the document transport direction. The turn roller 2C5 is positioned at the end of the transport path 2C2. When a document is driven into the transport path 2C2, the turn roller 2C5 is rotated in a direction for moving the document into the path 2C2. As soon as the sensor 2C4 senses the trailing edge of such a document, the turn roller 2C5 is reversed to drive the document out of the transport path 2C2.

Figure 4:
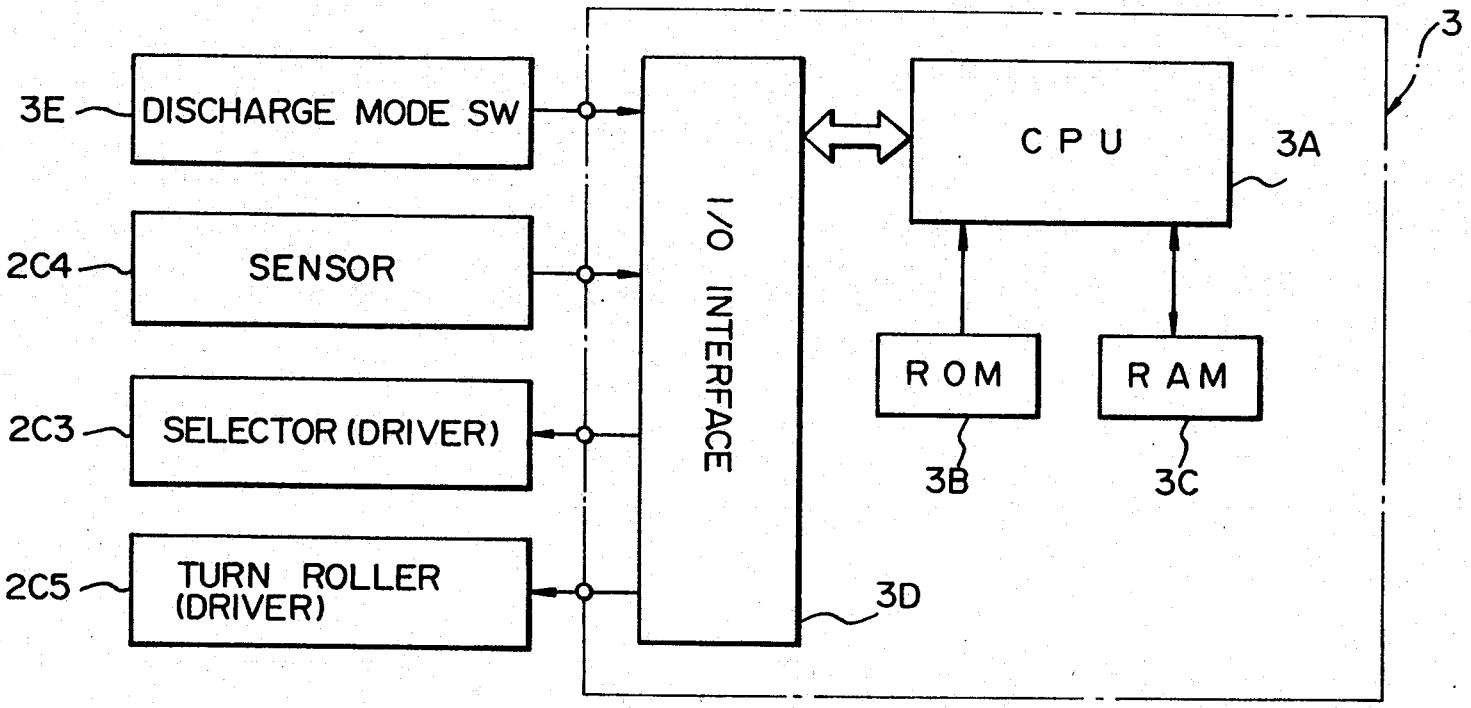
FIG. 4 is a block diagram schematically showing a control section associated with the embodiment.

As shown in FIG. 4, the control section, generally 3, has a microcomputer (CPU) 3A for executing sequence control associated with the image forming operation of the copier body 1. The CPU 3A includes a ROM 3B storing basic programs eccential for arithmetic and logical operations as well as basic data, and a RAM 3C for temporarily storing data therein. The CPU 3A is connected to external equipment via an input/output (I/O) interface 3D. Specifically, the sensor 2C4 of the ADF 2, a switch 3E provided on the copier body 1 for selecting a desired discharge mode, and a sensor 2A3, FIG. 2, built in the ADF 2 for sensing documents are connected to the input ports of the I/O interface 3D. Connected to the output ports of the I/O interface 3D are a drive section, not shown, for driving the pawl 2C3 and a drive section, not shown, for driving the turn roller 2C5.

The switch 3E provided on the copier body 1 is operable to select a desired copy discharge mode. In the illustrative embodiment, when the switch 3E is not operated, i.e., in an ordinary condition, it sets up a reversal discharge mode in which copies are sequentially discharged face down, as shown in FIG. 8D. When the switch 3E is operated, it sets up a mode in which copies are driven out face up without being turned over, as shown in FIGS. 10A-10D.

Figure 5:
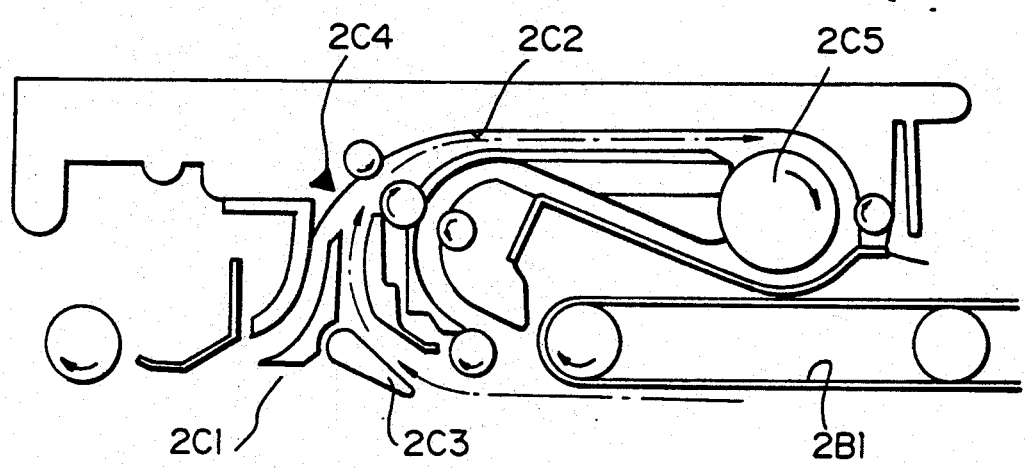
FIGS. 5 and 6 are views demonstrating the operation of the control section.
Figure 6:
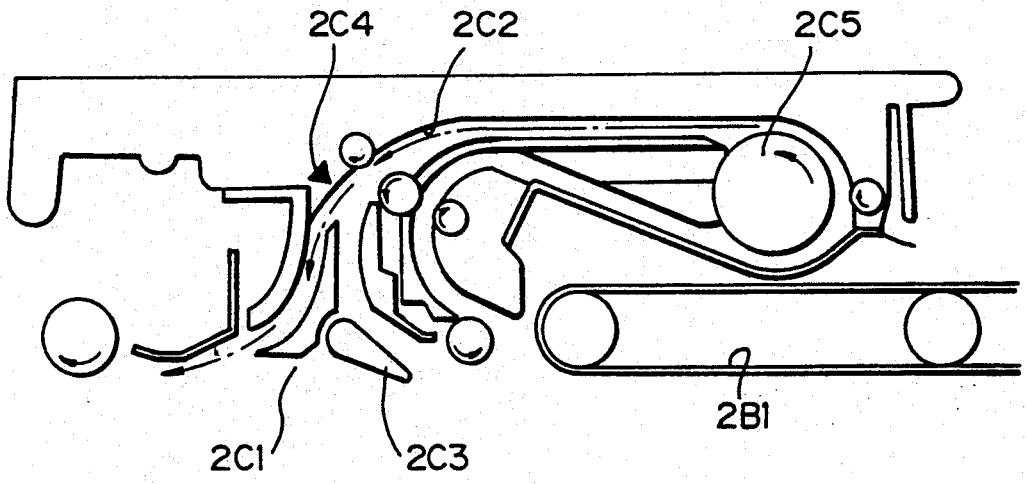

When the output of the switch 3E is representative of the ordinary condition, the CPU 3A positions the selector 2C3 such that a document from the belt 2B1 is directly driven into the transport path 2C1 and prevented from entering the other transport path 2C2, as shown in FIG. 3. When the switch 3E is operated to cancel the ordinary condition, the CPU 3A actuates the selector 2C3 such that a document from the belt 2B1 is steered into the transport path 2C2, as shown in FIGS. 5 and 6. Further, the CPU 3A reverses the turn roller 2C5 on the elapse of a predetermined period of time after the sensor 24C has sensed the trailing edge of the incoming document, in matching relation to the position of the selector 2C3. Hence, when a discharge mode for discharging copies face down as shown in FIGS. 8A-8D is selected, the documents are also discharged face down, i.e., the first page to the last page are sequentially driven out in this order. Conversely, when a mode for discharging copies face up, the last page being first, as shown in FIGS. 10A-10D, the documents are discharged in the same order as when fed out, but face up. As a result, the documents are sequentially stacked face up, the last page being first.

Figure 7:
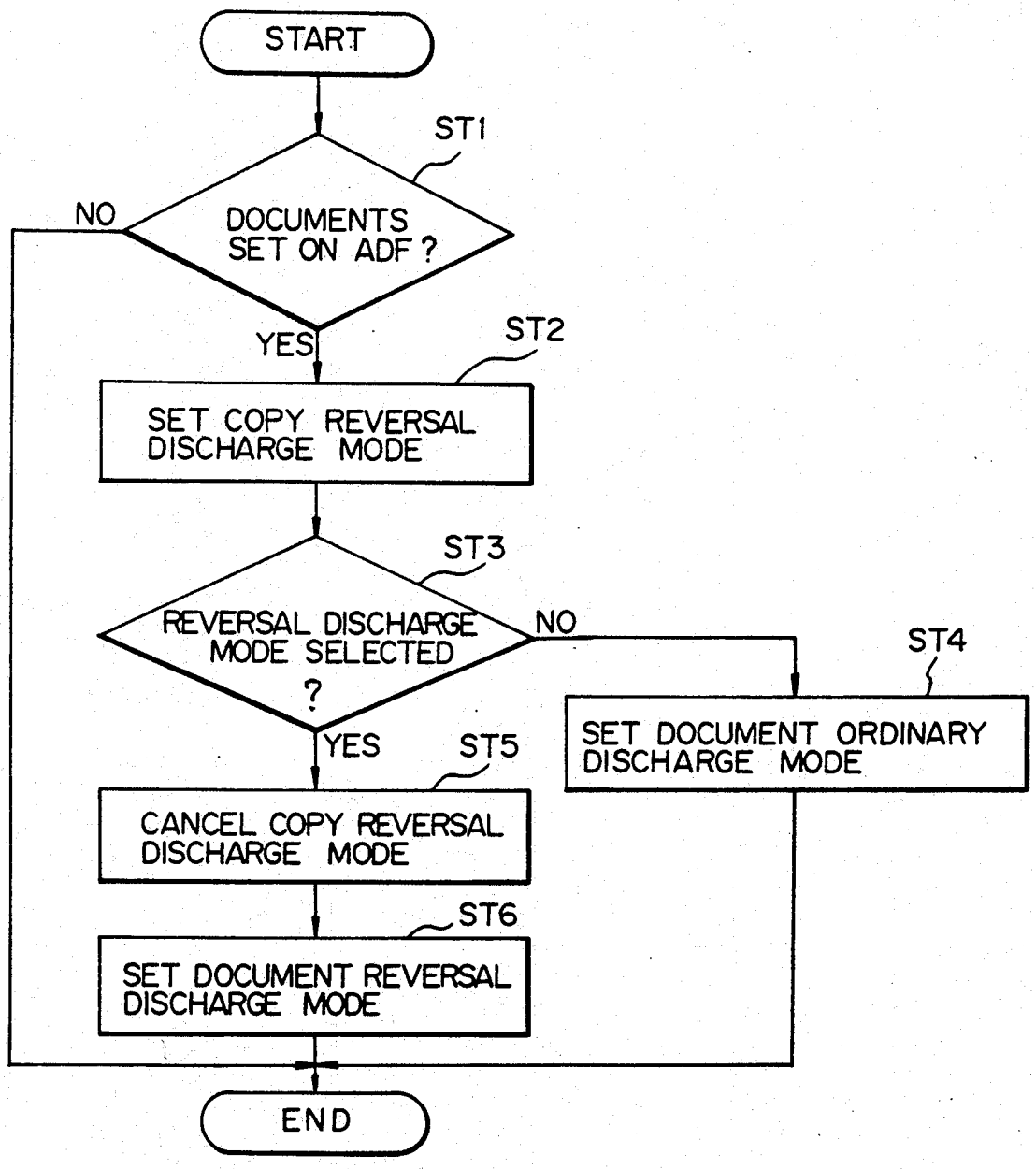
FIG. 7 is a flowchart representative of a specific procedure to be executed by the control section.

Referring to FIG. 7, the operation of the CPU 3A included in the embodiment will be described. First, the CPU 3A determines, in response to the output of the document set sensor 2A3, whether or not documents are present on the table 2A1 of the ADF 2 (step ST1). If documents are present, the CPU 2A sets up the discharge mode which reverses copies (ST2). Then, the selector 2C3 of the discharging section 2C is so positioned as to direct a document to the ordinary transport path 2C1, as shown in FIG. 3. After illumination, the document is transported by the belt 2B1 and driven out face down. The documents are set on the table 2A1 in the order shown in FIG. 8A and discharged in the order shown in FIG. 8B.

When the above-mentioned reversal discharge mode is selected, the CPU 3A determines whether or not such a discharge mode has been selected (ST3). This step is essential since the embodiment causes the copier body to initially set up the reversal discharge mode as an ordinary mode. If the answer of the step ST3 is negative, Y, the CPU 2A maintains the various members of the discharging section 2C in the existing positions to thereby discharge documents in the condition shown in FIGS. 8A–8D (ST4).

When the answer of the step ST3 is positive, i.e., when the reversal discharge mode is cancelled, the CPU 3A cancels the initially set reversal copy discharge mode (ST5) and changes the condition of the discharging section 2C for reversing documents. Specifically, the tip of the selector 2C3 protrudes into the ordinary transport path 2C1 to steer documents to the reversal transport path 2C2, as shown in FIGS. 5 and 6. At the same time, the turn roller 2C5 is rotated clockwise, as viewed in FIG. 5 (ST6). As a result, a document from the belt 2B1 is introduced into the transport path 2C2 and driven deeper into the path 2C2 by rollers included in the path 2C2 and the turn roller 2C5. As soon as the sensor 2C4 senses the trailing edge of the document, the turn roller 2C5 and associated rollers are reversed to switch back the document out of the transport path 2C5.

When the reversal copy discharge mode is cancelled, copies are discharged face up, as shown in FIGS. 10A–10D. Therefore, before documents are set on the table 2A1 of the feeding section 2A, they are rearranged to be fed face down from the last page to the first page. These documents are reversed by the discharging section 2C and, therefore, discharged face up from the last page to the first page.

In summary, it will be seen that the present invention provides an ADF which frees the operator from troublesome work such as for rearranging copies in order of page. Specifically, when the operator intentionally stacks the last page to the first page of documents in this order and sets them face down on a table in order to, for example, staple all the stacks of copies at the same position, the ADF of the present invention reverses the documents before discharging them. Hence, despite that the documents are discharged in the opposite order with respect to page, they are discharged face up to position the first page on the top of the resulting stack.

Various modifications will become possible for those skilled in the art after receiving the teachings of the present disclosure without departing from the scope thereof.

What is claimed is:

1. An automatic document feeder (ADF) for use with an image forming apparatus which discharges copy sheets carrying document images which have been formed thereon by the image forming appratus, said image forming apparatus selectively discharging said copy sheets in first and second orientations, wherein in the first orientation said document images of said copy sheets are in one of a face up and a face down orientation, and in the second orientation the copy sheets are in the other of a face up and a face down orientation, said ADF automatically sequentially feeding a plurality of documents having images thereon which are illuminated by said image forming apparatus and from which the document images of said copy sheets are formed, said ADF feeding said documents from a table to an illuminating position with the lowermost document fed first and sequentially discharging said documents, said ADF comprising:

a first discharge path for discharging said documents undergone illumination in a same orientation as an orientation in which said documents were fed from said table such that when said documents are placed face up on said table said documents are discharged face up and when said documents are placed face down on said table said documents are discharged face down;

a second discharge path for discharging said documents in a reversed orientation such that when documents are placed face down on said table said documents are discharged face up and when said documents are placed face up on said table said documents are discharged face down;

path selecting means for selecting between said first and second discharge paths such that when said copy sheets are discharged in the first orientation, said first discharge path is selected and when said copy sheets are discharged in the second orientation the second discharge path is selected.

2. An ADF as claimed in claim 1, wherein when said sheets carrying document images thereon are to be sequentially discharged face up from a last document page to a first document page, said documents are stacked on said table in such a manner as to be sequentially fed out from the last document page to the first document page while said path selecting means selects said second discharge path for discharging said documents undergone illumination via said second discharge path.

3. The automatic document feeder of claim 1, wherein the first orientation of said copy sheets is a face down orientation, and wherein said path selecting means includes an operator controlled selector switch and a processing unit, and wherein when said switch is in a first switch condition, said processing unit selects the first discharge path for said documents and provides a signal to said image forming device to cause said image forming device to discharge copy sheets in the first orientation, and wherein when said switch is in a second switch condition, said processing unit selects the second discharge path and provides a signal to said image forming apparatus to cause said image forming apparatus to discharge said copy sheets in the second orientation.

* * * * *